US012637864B2

(12) United States Patent
Gazlay

(10) Patent No.: US 12,637,864 B2
(45) Date of Patent: May 26, 2026

(54) PLATE FOR ROOFING APPLICATIONS WHERE A ROOF MEMBRANE HAS BEEN CUT OPEN FOR INSPECTION OR INSULATION REPLACEMENT AND MUST BE STITCHED BACK TOGETHER, AND A METHOD OF USING THE SAME

(71) Applicant: Brian Sullivan Gazlay, Wallingford, CT (US)

(72) Inventor: Brian Sullivan Gazlay, Wallingford, CT (US)

( * ) Notice: Subject to any disclaimer, the term of this patent is extended or adjusted under 35 U.S.C. 154(b) by 191 days.

(21) Appl. No.: 18/413,508

(22) Filed: Jan. 16, 2024

(65) Prior Publication Data

US 2025/0230657 A1 Jul. 17, 2025

(51) Int. Cl.
*E04D 5/14* (2006.01)

(52) U.S. Cl.
CPC ..... *E04D 5/145* (2013.01); *E04D 5/142* (2013.01)

(58) Field of Classification Search
CPC ..... E04D 5/145; E04D 5/142
See application file for complete search history.

(56) References Cited

U.S. PATENT DOCUMENTS 460,283 A 9/1891 Adler
981,362 A * 1/1911 Bell ..... E04D 5/142 52/549
1,930,632 A * 10/1933 Topping ..... E04D 5/146 405/302.1
1,952,383 A * 3/1934 Mcclanahan ..... E04D 5/145 52/471
3,049,836 A * 8/1962 Weissman ..... E04G 23/0281 29/402.09
4,520,606 A 6/1985 Francovitch
4,671,036 A 6/1987 Sullivan
4,999,963 A 3/1991 Verble
5,035,028 A 7/1991 Lemke
5,267,423 A * 12/1993 Giannuzzi ..... F16B 39/24 411/533
5,447,006 A * 9/1995 Zenor ..... E04D 5/149 52/514
5,452,558 A * 9/1995 Eastin ..... E04D 1/36 405/152
5,711,116 A 1/1998 Hasan
6,205,730 B1 3/2001 Hasan et al.
7,631,468 B2 12/2009 Gong et al.
7,779,592 B2 8/2010 Bernardi et al.
7,797,906 B2 9/2010 Kassem
8,733,718 B2 5/2014 Corsi
(Continued)

FOREIGN PATENT DOCUMENTS

NL 7906096 A * 2/1980 ..... E04D 5/149

*Primary Examiner* — Patrick J Maestri
(74) *Attorney, Agent, or Firm* — Dunlap Bennett & Ludwig PLLC

(57) ABSTRACT

A seam plate for securing a post-installation incision of a roofing membrane is disclosed. The seam plate provides a first portion and a second portion joined so as to define a lemniscate shape. A fastener aperture centrally disposed in each of the first and second portions. The seam plate dimensioned and adapted to secure the incision by spanning the incision so that the first and second portions are on opposites sides of the incision, and then fastening the first and second portions to structure subjacent the roofing membrane.

5 Claims, 3 Drawing Sheets

(56) References Cited

U.S. PATENT DOCUMENTS

| | | | |
|---|---|---|---|
| 9,309,911 | B1 | 4/2016 | Powell |
| 9,683,369 | B2 | 6/2017 | Shevlin |
| 10,844,603 | B2 | 11/2020 | Egan |
| 11,205,989 | B2 | 12/2021 | Mayfield et al. |

* cited by examiner

PLATE FOR ROOFING APPLICATIONS WHERE A ROOF MEMBRANE HAS BEEN CUT OPEN FOR INSPECTION OR INSULATION REPLACEMENT AND MUST BE STITCHED BACK TOGETHER, AND A METHOD OF USING THE SAME

BACKGROUND OF THE INVENTION

The present invention relates to roof membrane fastening plates, systems, and methods and, more particularly, to a plate for roofing applications where a roof membrane has been cut open for inspection or insulation replacement and must be stitched back together, and a method of using the same.

From time to time, roofing systems need intrusive inspections for repair of simple leaks or during more intensive roof restoration processes such as, but not limited to, insulation replacement and decking replacement operations. In fact, roof restorations are one of the fastest growing sectors of the roofing industry. Part and parcel of such roof restorations is mandatory post-operative membrane-sealing for providing a warranty. The current method of stitching up the incision includes fastening one roof plate to one side of the incision and, separately, a fastening a second roof plate to other side of the incision, wherein the first and second roof plates are not physically connected. As a result, the roof membrane can shrink. Furthermore, the prior art methodology of inserting a separate roof plate on each side of the membrane allows for excessive shifting of the membrane. This disadvantageously results in future failures of the roofing system when the movement in the membrane becomes great enough to tear or crack at the new operative seam. Thus, when these incisions are made to pre-existing roofing systems, many times these incision points become future points of failure.

In sum, current available hardware is not sufficient or well suited to repair these incisions or tears due to horizontal and lateral movements. These movements can and do eventually tear the subject membrane due to horizontal and lateral movements. When two adjacent membranes are not held tightly together, they may pull apart, slide, or vibrate from high to low pressures above the membrane caused by wind. These conditions may cause failures of the incision.

As can be seen, there is a need for a roofing seam plate for roofing applications where a roof membrane has been cut open for inspection or insulation replacement and must be stitched back together, and a method of using the same, since using two fastened roof plates, one on each side of the operative seam does not adequately provide enough lateral hold to help prevent future tearing at these incisions points or lines.

SUMMARY OF THE INVENTION

The seam plate embodied in the present invention helps to seal and mitigate failures stemming from incisions in pre-existing roofing membrane.

This seam or stitch plate provides the roofer with a mechanical device which will hold together a new seam in a cut section of roofing membrane both laterally and horizontally, as well as prevent the seam of incised roof member from lifting vertically.

The seam plate of the present invention may incorporate a plurality of fasteners which will hold into the roof decking, rather than just one screw. This is important because during the life span of a roof, shrinking of the membrane causes excessive stress on the seams. When the plate with two screws is utilized, this will hold the membrane in place better while reducing stress on the seams. Utilizing a plate which spans the incision with one or more fasteners on each side of the seam will hold the incision together better, thereby preventing future cracking or tearing at the incisions made in the membrane.

Currently, membrane roof incisions are stitched back together using a single plate and on each side of the incision. In contrast, the disclosed seam plates will span the incision, fastened on each side of the incision, providing enhanced support to the incision through the disclosed method of using the seam plate.

In one aspect of the present invention, A method of securing a post-installation incision of a roofing membrane, the method includes the following: spanning the incision with a seam plate having a first portion and a second portion; and fastening the first and second portions on opposing sides of said incision to a structure subjacent the roofing membrane, wherein fastening includes penetrating an aperture provided by each portion, respectively.

In another aspect of the present invention, the seam plate for securing a post-installation incision of a roofing membrane, the seam plate includes the following: a first portion and a second portion joined so as to define a lemniscate shape; and a fastener aperture centrally disposed in each said portion as well as a plurality of circumferentially spaced barbs extending downward from an underside of each portion.

Furthermore, since current solutions employ only one screw per plate, this is inferior to the present invention using two screws per plate, which ensures the incision is more tightly closed than the prior art.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a seam plate for securing a post-installation incision of a roofing membrane, wherein seam plate provides a first portion and a second portion joined so as to define a lemniscate shape. A fastener aperture centrally disposed in each of the first and second portion. The seam plate dimensioned and adapted to secure the incision by spanning the incision so that the first and second portions are on opposites sides of the incision, and then fastening the first and second portions to structure subjacent the roofing membrane.

Figure 1:
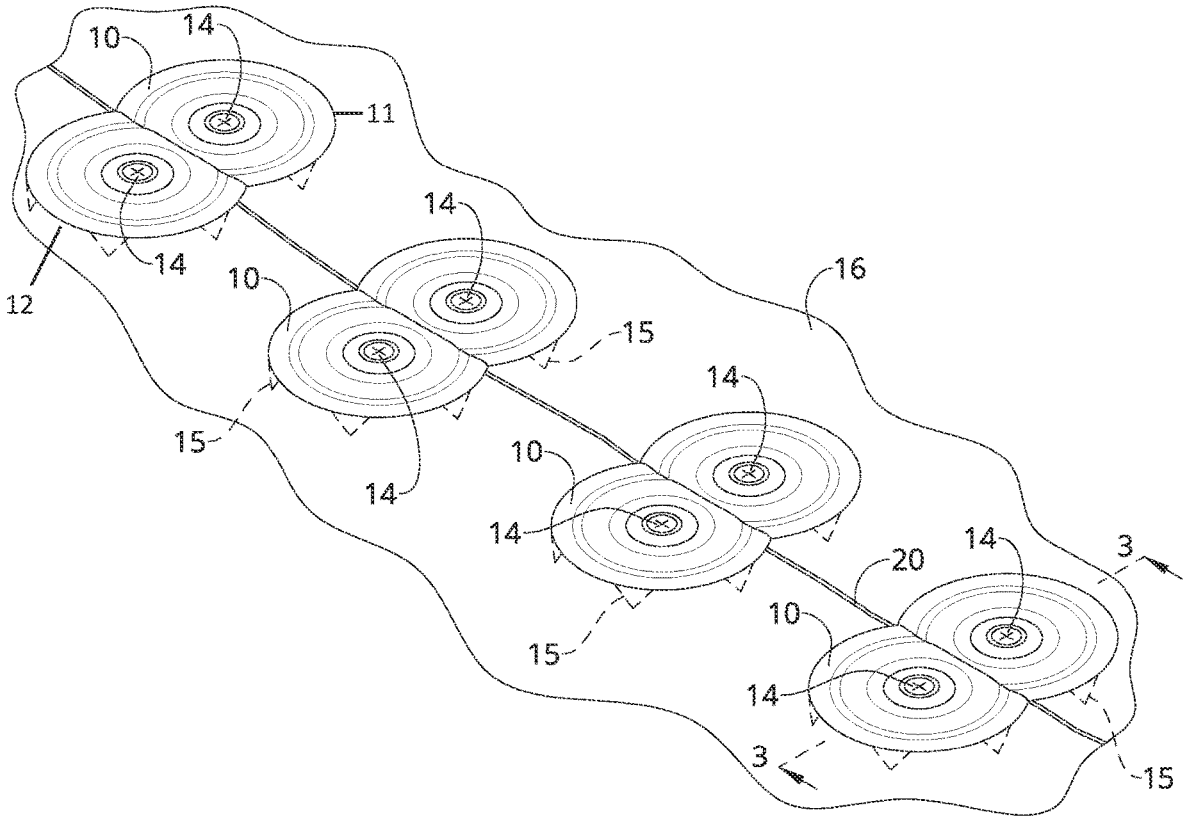
FIG. 1 is a perspective view of an exemplary embodiment of the present invention, shown in use.
Figure 2:
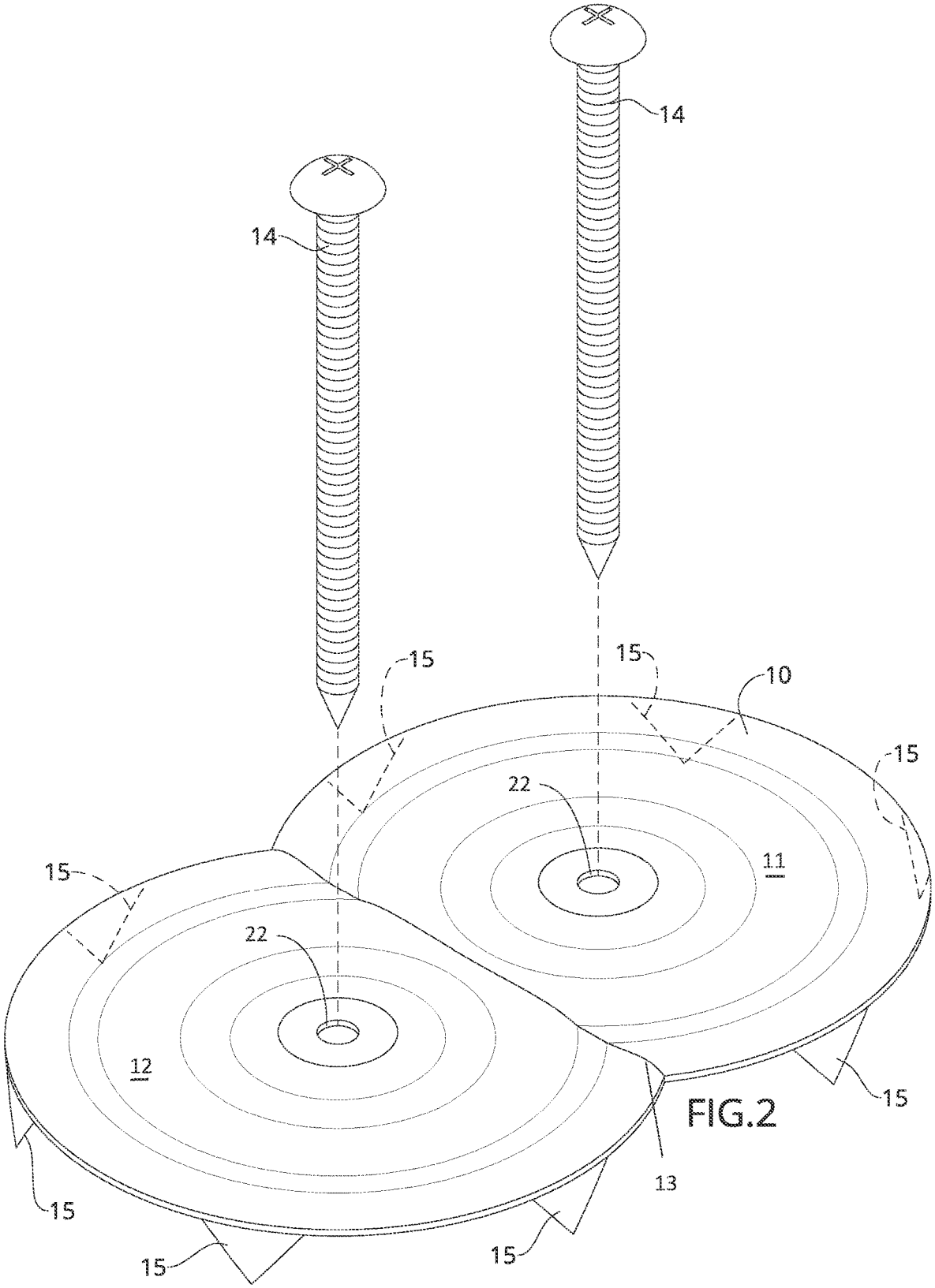
FIG. 2 is an exploded perspective view of an exemplary embodiment of the present invention.
Figure 3:
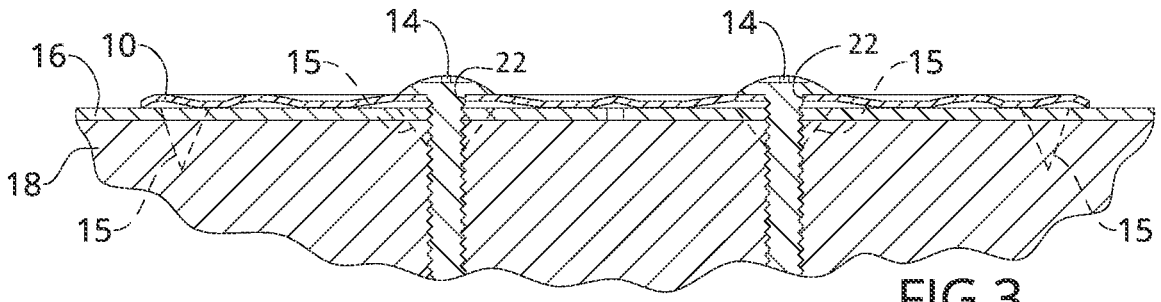
FIG. 3 is a section view of an exemplary embodiment of the present invention, taken along line 3-3 in FIG. 1.

Referring to FIGS. 1 through 3, the present invention may include a seam plate 10 having a lemniscate shape, composed of two partially circular disks joined to form a 'figure 8'. The two partially circular disks may include a first portion 11 and a second portion 12, separated by a joint line 13. Each portion 11, 12 has a centrally disposed aperture 22 (wherein the aperture 22 is located at what would be the center of the wholly circular disk) for receiving a fastener 14, such as a screw. Each portion 11,12 may have a plurality of ribs (generally concentric, if that portion were a wholly circular disk) for providing reinforcing and bending or flexibility characteristics to the seam plate 10, and a plurality of circumferentially spaced apart barbs 15 extending downward from an underside of each portion 11,12. The barbs 15 are dimensioned and shaped to aid the plate in the steady hold of the membrane to the seam plate 10 as well as not allowing the seam plate 10 to twist during installation, whereat the rotational force utilized to install a fastener 14 may convey torque to the seam plate 10.

Seam plate 10 may be a one-piece stamped plate made from galvanized steel or aluminum stock or equivalent. The two apertures 22 central on each side of the figure-8-shaped seam plate 10 are to allow a fastener 14 (e.g., a deck screw) to go through the seam plate 10 on each side of an incision 20 along a roofing membrane 16. The joint line 13 may facilitate lining the seam plate 10 properly relative to the incision 20; specifically, where the seam plate 10 is placed so that the joint line 13 substantially aligns with the incision 20. The head of the screw fastener 14 will rest on the top side of the seam plate 10, as shown in the Figures. The screw head will press the seam plate 10 into the roofing membrane 16. The barbs 15 protruding on the bottom side of seam plate 10 will help grab onto and secure the membrane 16. The entire plate will place pressure not only on the membrane, but onto the roofing insulation 18, substrate, and roof decking as well.

The seam plate will span across an incision 20, or a cut section of membrane 16 with the seam/slice/cut/incision 20 running down the middle of the seam plate 10 between the two screws. Thereby placement of the seam plate 10, spanning the incision 20, wherein the first and second portions 11 and 12 are on opposite sides of the incision 20, will not only hold the vertical movement of the membrane, but it will also hold the membrane together. This will allow for stronger stitching methods which are currently utilized for these types of roofing operations.

The screws 14 and the barbs 15 in the plate will help hold the membrane in place by grabbing into or penetrating the roofing membrane. The compression generated from the screw head of the fastener 14 downwards onto the seam plate 10, the membrane 16, insulation 18, and related substrate will pinch these materials between the seam plate 10 and the roof deck. This pinching element will also help to hold the membrane 16 from shifting or other lateral or horizonal movement.

Different variations of these plates could be utilized. The plates shown in the figures are similar in shape to an 8 or infinity symbol. There could be variations of ovals, square, rectangle, and triangles. The number of screw apertures could also be increased. A triangle shape may have three screw holes. A rectangular or oval shape could have either two, three or more screw holes. The desire to hold the roof membrane in place from lateral and vertical movements would remain the same.

The current method of "stitching" roofing seams together with mechanical fasteners allows for horizontal or lateral movement of the roofing membrane. This plate helps to eliminate said horizontal or lateral movements. The problem with lateral and horizontal movements of the roofing membrane is these movements can tear the sealants, fabrics, or tapes which are used to hold and seal the roof membranes together while making the membrane watertight. When these fabrics, tapes or sealants fail it typically results in a roof leak. This is why it is necessary to keep the membrane sections from moving independently of one another.

It should be understood that the term "seam" used in the disclosure includes an cut or opening along a roofing or construction membrane, and so the present invention can be used on any membrane that has been recently cut open as well as existing seams on roofing systems that are failing due to shrinkage or elimination, or any other reason, resulting in two portions of a membrane or membranes that are pulled apart and that the user wants held adjacent each other with sufficient lateral hold to prevent tearing or shifting.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A method of securing a post-installation incision of a roofing membrane, the method comprising:

spanning the incision with a seam plate having a first portion and a second portion, wherein the first and second portions interface at a joint line, wherein each portion has a fastener aperture, wherein each portion has concentric ribbing relative to said fastener aperture;

aligning the joint line with the incision so that a concave portion of the ribbing is immediately over the incision; and fastening the first and second portions on opposing sides of said incision.

2. The method of claim 1, further comprising fastening the first and second portions to a structure subjacent the roofing membrane.

3. The method of claim 2, wherein fastening includes penetrating said fastener aperture provided by each portion, respectively.

4. A seam plate for securing a post-installation incision of a roofing membrane, the seam plate comprising:

a first portion and a second portion joined so as to define a lemniscate shape, wherein the first and second portions interface at a joint line; and two fastener apertures, each fastener aperture is centrally disposed in each said portion so as to be spaced apart from the joint line.

5. The seam plate of claim 4, further comprising a plurality of circumferentially spaced barbs extending downward from an underside of each portion.

* * * * *